US007380360B2

(12) United States Patent
Evans et al.

(10) Patent No.: US 7,380,360 B2
(45) Date of Patent: Jun. 3, 2008

(54) SIGN-BEARING ROAD STAND

(76) Inventors: Patrick H. Evans, 3054 S. 2000 East, Salt Lake City, UT (US) 84109; Teresa A. Evans, 3054 S. 2000 East, Salt Lake City, UT (US) 84109

( * ) Notice: Subject to any disclaimer, the term of this patent is extended or adjusted under 35 U.S.C. 154(b) by 71 days.

(21) Appl. No.: 10/238,249

(22) Filed: Sep. 10, 2002

(65) Prior Publication Data

US 2003/0046840 A1 Mar. 13, 2003

Related U.S. Application Data

(60) Provisional application No. 60/322,108, filed on Sep. 10, 2001.

(51) Int. Cl.
*G09F 1/08* (2006.01)

(52) U.S. Cl. ..... 40/538; 116/63 P; 40/607.1; 40/612

(58) Field of Classification Search ..... 40/538, 40/607.1, 612, 124.4; 116/63 P, 63 R; 248/151, 248/158, 908; 434/99, 396; 223/85
See application file for complete search history.

(56) References Cited

U.S. PATENT DOCUMENTS

| | | | | | |
|---|---|---|---|---|---|
| 191,914 | A | * | 6/1877 | Beausoleil | 40/538 X |
| D59,241 | S | | 10/1921 | Lion | |
| D59,726 | S | | 11/1921 | Ellis | |
| D72,148 | S | | 3/1927 | Gill | |
| D90,399 | S | | 8/1933 | Coon | |
| D98,028 | S | | 12/1935 | Felz | |
| D99,034 | S | | 3/1936 | Le Fevre | |
| 2,145,322 | A | * | 1/1939 | Snider | |
| D116,527 | S | | 9/1939 | Forbell | |
| 2,231,795 | A | * | 2/1941 | Brown | 40/538 X |
| 2,309,447 | A | * | 1/1943 | Greneker | 40/538 X |
| 2,349,706 | A | * | 5/1944 | Collins | 40/538 |
| 3,252,243 | A | * | 5/1966 | Doyle et al. | 446/98 |
| 4,068,398 | A | * | 1/1978 | Parisi | 40/610 X |
| 4,115,937 | A | * | 9/1978 | Wolpert | |
| 4,356,659 | A | | 11/1982 | Clarke | |
| D307,606 | S | | 5/1990 | Jervis, Sr. | |
| D308,229 | S | | 5/1990 | Jervis, Sr. | |
| 5,001,475 | A | * | 3/1991 | Scovin | 40/612 |
| 5,362,271 | A | | 11/1994 | Butt | |
| D388,724 | S | | 1/1998 | Victor et al. | |
| 5,906,064 | A | * | 5/1999 | Field | |
| D414,815 | S | | 10/1999 | McDonald | |
| D434,081 | S | | 11/2000 | Gruber | |
| 6,204,777 | B1 | | 3/2001 | Lyons | |

FOREIGN PATENT DOCUMENTS

| | | | | |
|---|---|---|---|---|
| BE | 556521 | * | 4/1957 | 40/538 |
| GB | 2245402 | * | 1/1992 | 40/538 |

* cited by examiner

*Primary Examiner*—Joanne Silbermann
(74) *Attorney, Agent, or Firm*—Kirton & McConkie; David B. Tingey

(57) ABSTRACT

A road stand comprising a substantially planar cut-out figure. The figure bears a sign having a design thereon appropriate to attract the attention of passers-by. The figure is supported by a free-standing base.

58 Claims, 11 Drawing Sheets

SIGN-BEARING ROAD STAND

BACKGROUND

1. Related Application

This application claims priority to U.S. Provisional Patent Application Ser. No. 60/322,108, filed Sep. 10, 2001, and titled SIGN-HOLDING CHILD FIGURE ROAD STAND.

2. Field of the Invention

The present invention relates generally to methods and apparatus for attracting the attention of passers-by. More particularly, the present invention relates to sign-bearing road stands.

3. Background

In today's society, many people own vehicles and drive them on a daily basis. Since driving is often an aspect of everyday life, drivers become accustomed to and habitually ignore signs that are commonly seen on the roadside. Signs such as billboards are frequently taken for granted, making such form of advertising less profitable for the sponsors. Other signs such as yield signs, stop signs, or school crossing signs have more serious consequences when ignored. Even signs held by crossing guards who stand in the middle of a crosswalk sometimes go unnoticed. Hence, there is a great need in the art for a simple yet eye-catching roadway sign.

SUMMARY AND OBJECTS OF THE INVENTION

The present invention may be characterized generally as an attention-grabbing, easy-to-assemble, roadway stand comprising a substantially planar figure that bears a sign. The planar figure is supported by a free-standing base.

In the preferred embodiments, the planar figure is an outline of a child and is made of an aluminum-plastic composite material (such as, for example, the material currently sold under the trademark Dibond™), or other suitable material. The planar figure is also preferably clothed and has facial features. It is preferred that the planar figure comprises multiple parts that are joined at the waist and at the wrists to allow for easy interchangeability of parts as well as to facilitate the disassembly and transportation of the planar figure.

The sign is preferably made of lightweight plastic (such as that currently sold under the trademark Sintra™). Also, in the preferred embodiments, the base is made of aluminum-plastic composite material and is attached to the planar figure by means of notched lap joints. Additionally, the planar figure is preferably provided with facial and hair features comprising removable stickers.

Accordingly, it is an object of some embodiments of the present invention to provide an eye-catching road stand that is simple and inexpensive to manufacture.

Another object of some embodiments of the present invention is to provide a road stand comprising a character-faced figure having simplified features.

A further object of some embodiments of the present invention is to provide an attention-grabbing child figure road stand that effectively warns motorists at school crossings to slow down.

Another object of some embodiments of the present invention is to provide a substantially planar road stand that is cut into a simplified figure, the figure being supported by a notched base.

Yet another object of some embodiments of the present invention is to provide a sign-holding child figure road stand with removable sticker features.

Another object of some embodiments of the present invention is to provide a substantially planar child figure road stand having arms that hold a removable sign.

A further object of some embodiments of the present invention is to provide a child figure road stand having slip joints at the waist and at the wrists to facilitate transportation of the child figure as well as the interchangeability of parts.

These and other objects and features of the present invention will become more fully apparent from the accompanying drawings, detailed description, and claims. Other objects will likewise become apparent from the practice of the invention as set forth hereafter.

BRIEF DESCRIPTION OF THE DRAWINGS

Although the drawings depict only typical embodiments of the invention and are thus not to be deemed limiting of the invention's scope, the accompanying drawings help explain the invention in added detail.

DETAILED DESCRIPTION OF EMBODIMENTS OF THE PRESENT INVENTION

The following detailed description, in conjunction with the accompanying drawings (hereby expressly incorporated as part of this detailed description), sets forth specific numbers, materials, and configurations in order to provide a thorough understanding of the present invention. The following detailed description, in conjunction with the drawings, will enable one skilled in the relevant art to make and use the present invention.

The purpose of this detailed description being to describe the invention so as to enable one skilled in the art to make and use the present invention, the following description sets forth various specific examples, also referred to as "embodiments," of the present invention. While the invention is described in conjunction with specific embodiments, it will be understood, because the embodiments are set forth for explanatory purposes only, that this description is not intended to limit the invention to these particular embodiments. Indeed, it is emphasized that the present invention can be embodied or performed in a variety of ways. The drawings and detailed description are merely representative of particular embodiments of the present invention.

Reference will now be made in detail to several embodiments of the invention. The various embodiments will be described in conjunction with the accompanying drawings wherein like elements are designated by like alphanumeric characters throughout.

Figure 1:
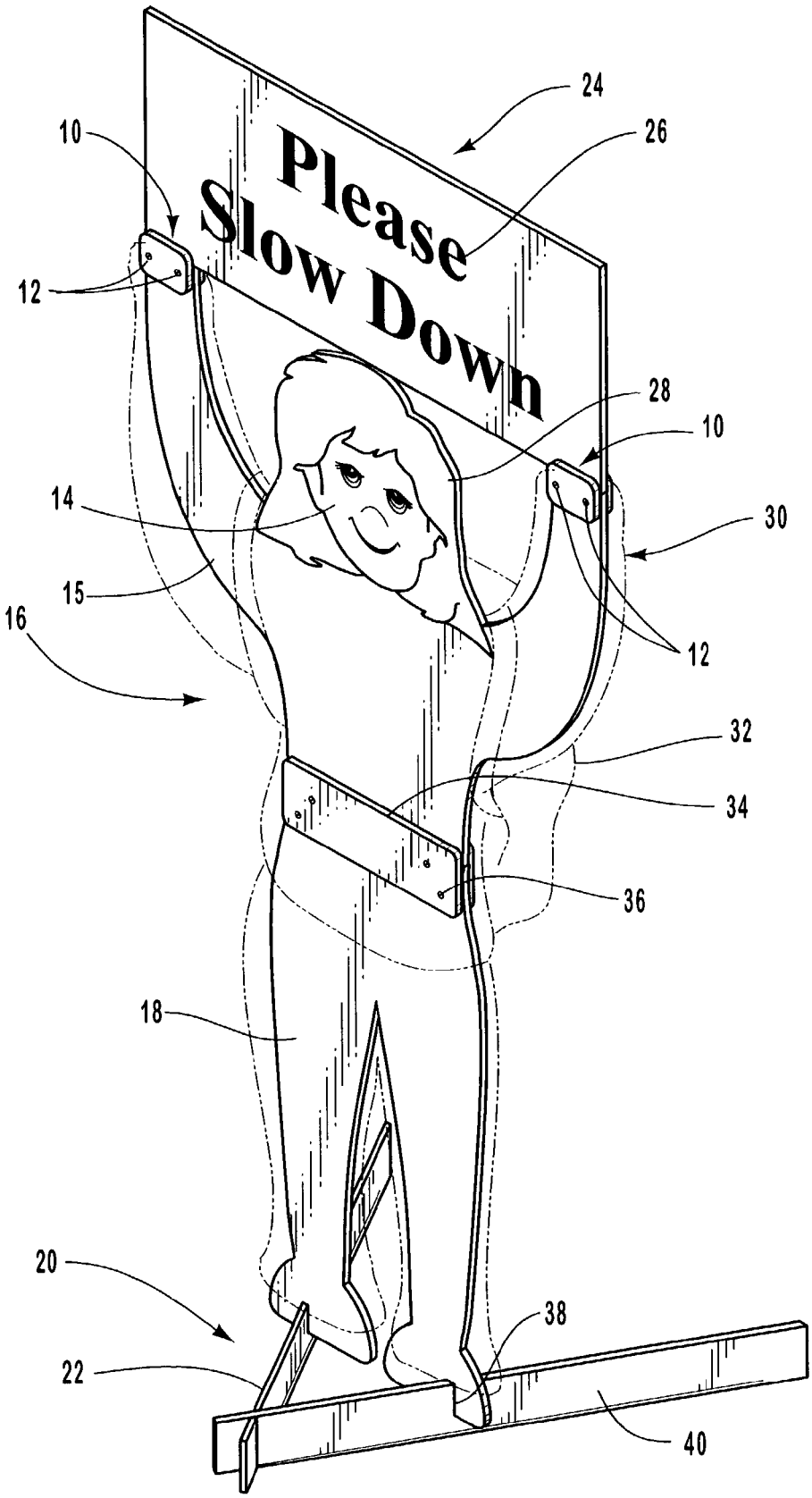
FIG. 1 is a perspective view of a preferred embodiment of the present invention.

With reference now to the accompanying drawings, FIG. 1 shows a perspective view of a preferred embodiment of the present invention that is intended to be placed in an area through which school children pass. The present invention basically comprises a planar FIG. 16, a sign 24 on the planar FIG. 16, and a base 20 supporting the planar FIG. 16.

Figure 16:
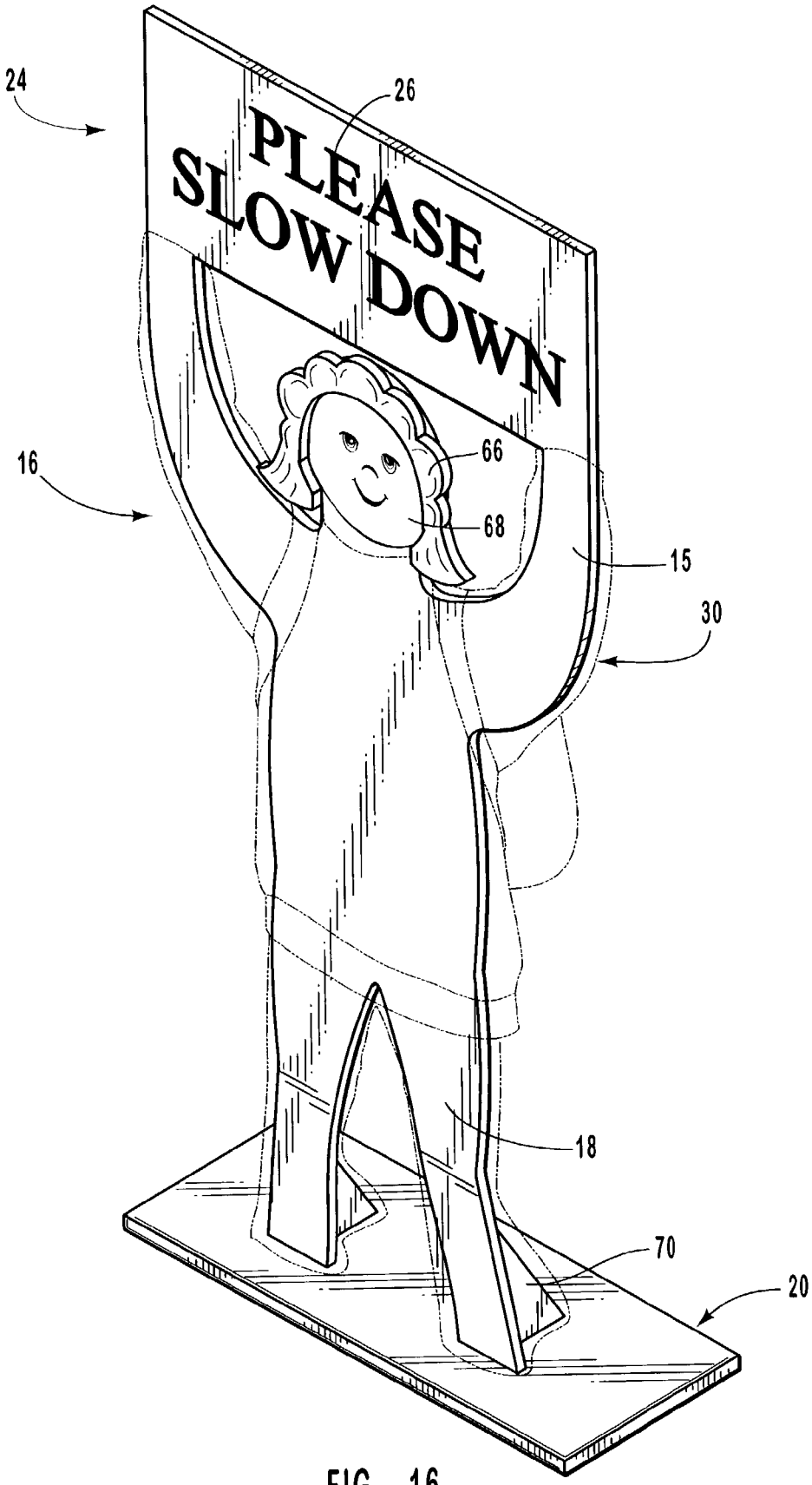
FIG. 16 is a perspective view of one embodiment of the present invention.

The planar FIG. 16 preferably comprises an arm or arms 15, a face 14, a hairdo or hair 28, legs 18, and clothes 30 (the latter here being shown in phantom lines). The planar FIG. 16 is made by cutting out an outline of a pre-determined form from a sturdy board preferably comprised of Dibond™ Aluminum-plastic composite material. The planar FIG. 16 may instead be made of other materials such as standard fiberboard, particleboard, plywood, metals, or other suitable sturdy material. Possible examples of plywood include Medium Density Overlay (MDO) plywood and any other types of plywood, whether finished or unfinished on one or both sides of the plywood.

The form or shape of planar FIG. 16 may reflect various outlines of a body, including that of a human, an animal, a monster, or a science fiction character. The preferred embodiment comprises an outline of a child, as shown in FIG. 1. In addition, in the preferred embodiments of the present invention, the outline of the planar FIG. 16 is simple so that it can be easily cut out by a computer-programmed saw. The planar FIG. 16 is "planar" in that it is relatively two-dimensional—as opposed to a three-dimensional figure such as a mannequin.

The design of the face 14 and/or hair 28 or other features such as shoes (not shown) may be added to the planar FIG. 16 in any type of way. For example, the design can be painted on, silk-screened, or attached as a separate piece to the planar FIG. 16 via a sticker, wood piece, or other planar or three-dimensional material. Moreover, the face 14 and hair 28 can comprise separate pieces or can be one integral piece. In the preferred embodiments, the face 14 and hair 28 together comprise an integral removable sticker, an example of which is shown in FIG. 1. In some embodiments, the planar FIG. 16 comes with one face 14 that is genderless and two interchangeable hairdos 28, one hairdo of which represents the hairdo of a female, and one of which represents the hairdo of a male. In the preferred embodiments, the design of the face 14 and/or hair 28 is of a cartoon-like or character-like design. Of course, the designs can reflect any type of gender.

As with the face 14 and hair 28, clothes 30 may be added to the planar FIG. 16 in any type of way, including by paint, silk-screen, or attachment via a separate sticker, wood piece, or other planar or three-dimensional materials. Clothes 30 include standard clothing such as shirts, pants, and skirts as well as other accessories such as a backpack 32. In the preferred embodiments of the present invention, the clothes 30 are not supplied to the purchaser of the planar FIG. 16 so that the purchaser can choose how to clothe the planar FIG. 16. In some situations, it will be convenient to use clothing 30 that was originally designed to be worn by humans.

The sign 24 has a design 26 on it that includes lettering and/or pictures that are large enough to attract the attention of people passing by the planar FIG. 16. For example, the lettering on the sign 24 of FIG. 1 should be large enough so that, when the planar FIG. 16 is placed on or near a road, people traveling in vehicles passing by the planar FIG. 16 are able to read the lettering. "Please slow down," "Exit only," and "Please go this direction" are just a few examples of what might be displayed on the sign 24. Additionally, in some preferred embodiments of the present invention, the lettering resembles the handwriting of a child.

The sign 24 is preferably substantially planar and is cut from a sturdy board. Sign 24 may be made of the same material as the planar FIG. 16 or with any other suitable material. In the preferred embodiments, the sign 24 is made of lightweight plastic (such as Sintra™ plastic) and has an aluminum backing to prevent warping in warm weather.

The sign 24 may be formed integrally with the planar FIG. 16 or may be a separate piece. If a separate piece, the connection between the sign 24 and the planar FIG. 16 may embody various forms, some of which will be described further herein. In the preferred embodiments, the arms 15 of the planar FIG. 16 are preferably in an uplifted position for bearing the sign 24 above the planar FIG. 16.

Figure 3:
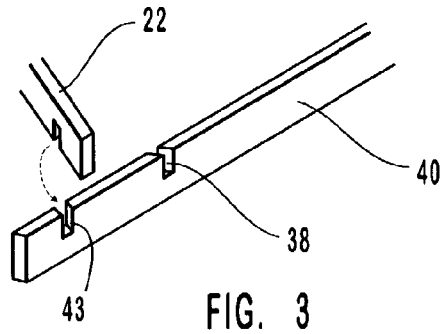
FIG. 3 is a detail view showing how the base of FIG. 1 is assembled.

The base 20 is designed to be a stand-alone or free-standing base. In other words, the base 20 is designed to support the planar FIG. 16 without requiring the base 20 and/or the planar FIG. 16 to lean against anything for additional support. The preferred base 20 of the present invention, an example of which is shown in FIG. 1, and, in more detail in FIG. 3, comprises a right plank 22 and a left plank 40 coupled together at an acute angle. Each of the planks 22 and 40 has a notch 38 therein for supporting the planar FIG. 16. In addition, as can be seen in FIG. 3, each of the planks 22 and 40 include an additional notch 43 whereby the planks are coupled together. The dotted arrow in FIG. 3 shows how the planks 22 and 40 are coupled together.

The base 20 may comprise the same material as the planar FIG. 16; the preferred material for the base 20 is Dibond™ aluminum-plastic composite material. As with the sign 24, the base 20 may be integral with the planar FIG. 16 or comprise a separate piece.

Figure 2:
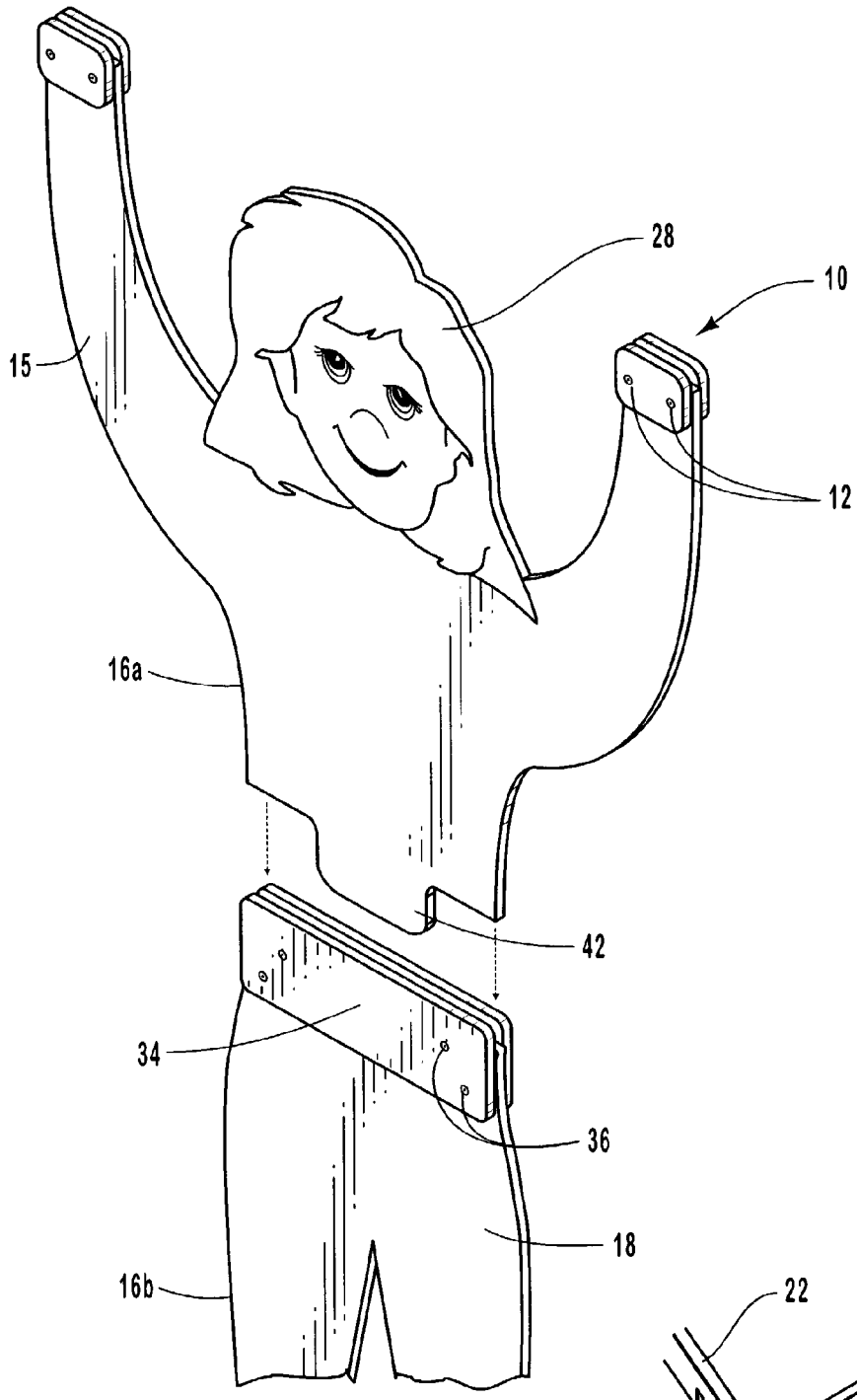
FIG. 2 is an enlarged exploded view showing the middle section of the embodiment of FIG. 1.

The planar FIG. 16 itself may also comprise one integral piece or multiple separate pieces. In the preferred embodiments, the planar FIG. 16 comprises multiple separate pieces to facilitate disassembly and transportation as well as the interchangeability of parts. FIG. 2 illustrates a preferred embodiment of the planar FIG. 16 wherein the planar FIG. 16 has a top part 16*a* and a bottom part 16*b* coupled together by a slip joint. The slip joint comprises a connector 34 that is permanently coupled to the bottom part 16*b* with rivets 36. The connector 34 comprises two planks that sandwich the adjacent end of the bottom part 16*b* as shown. The slip joint also comprises a tongue 42 that extends from the top part 16*a* of the planar FIG. 16. The tongue 42 slips into the cavity defined by the two planks of the connector 34. Note that the top part 16*a* and bottom part 16*b* can thus be easily disconnected.

Likewise, as shown in FIG. 2, the preferred embodiments of the present invention are designed so that the sign 24 is connected to the arms 15 of the planar FIG. 16 via slip joints. These slip joints comprise connector 10 and rivets 12 and work similarly to connector 34 and rivets 36 to hold the sign 24 in place. However, these slip joints do not have a tongue portion extending from the sign 24.

Figure 4:
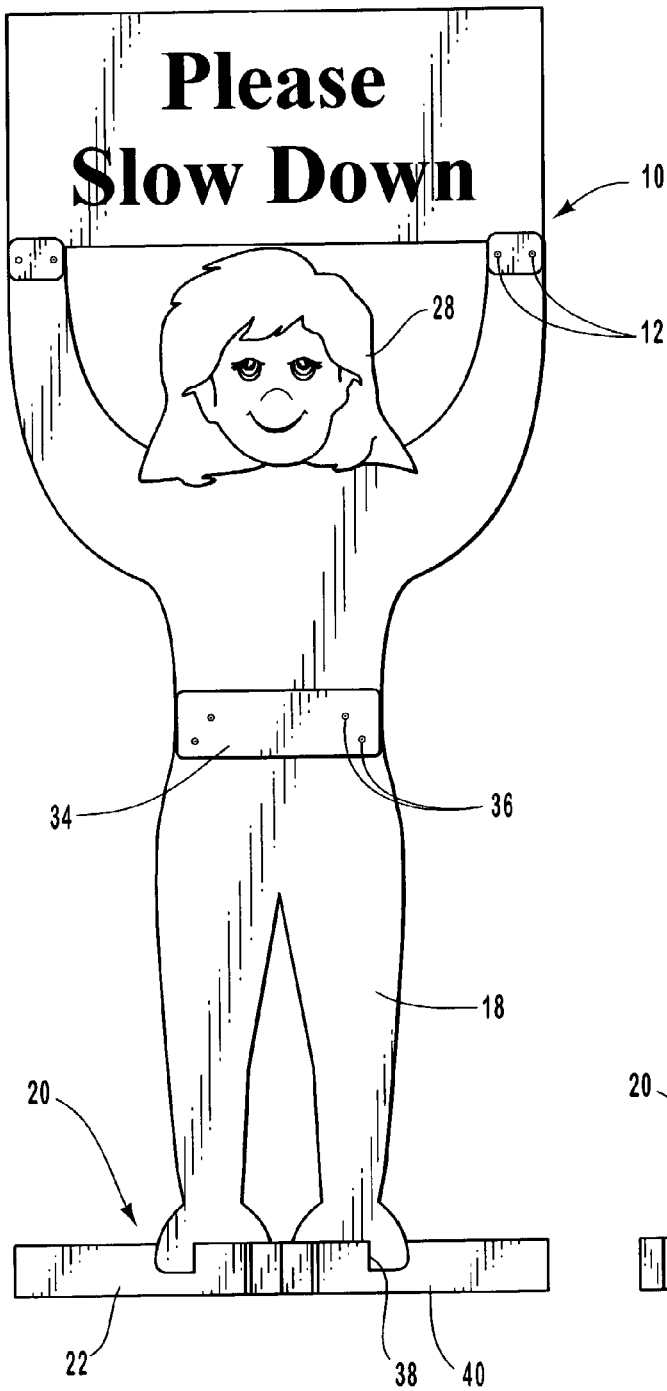
FIG. 4 is a front view of the embodiment shown in FIG. 1.
Figure 5:
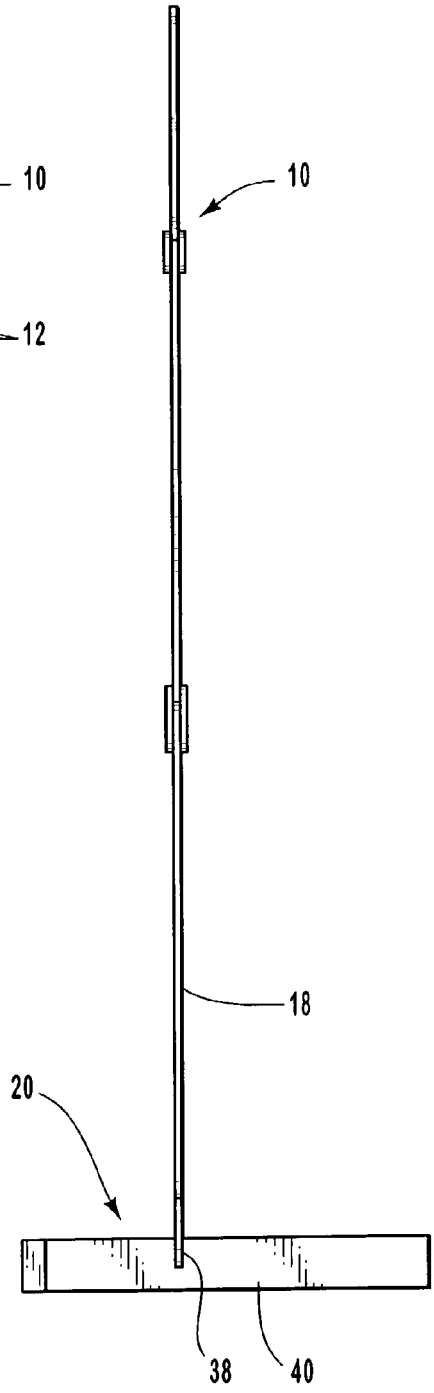
FIG. 5 is a left side view of the embodiment shown in FIG. 1.
Figure 6:
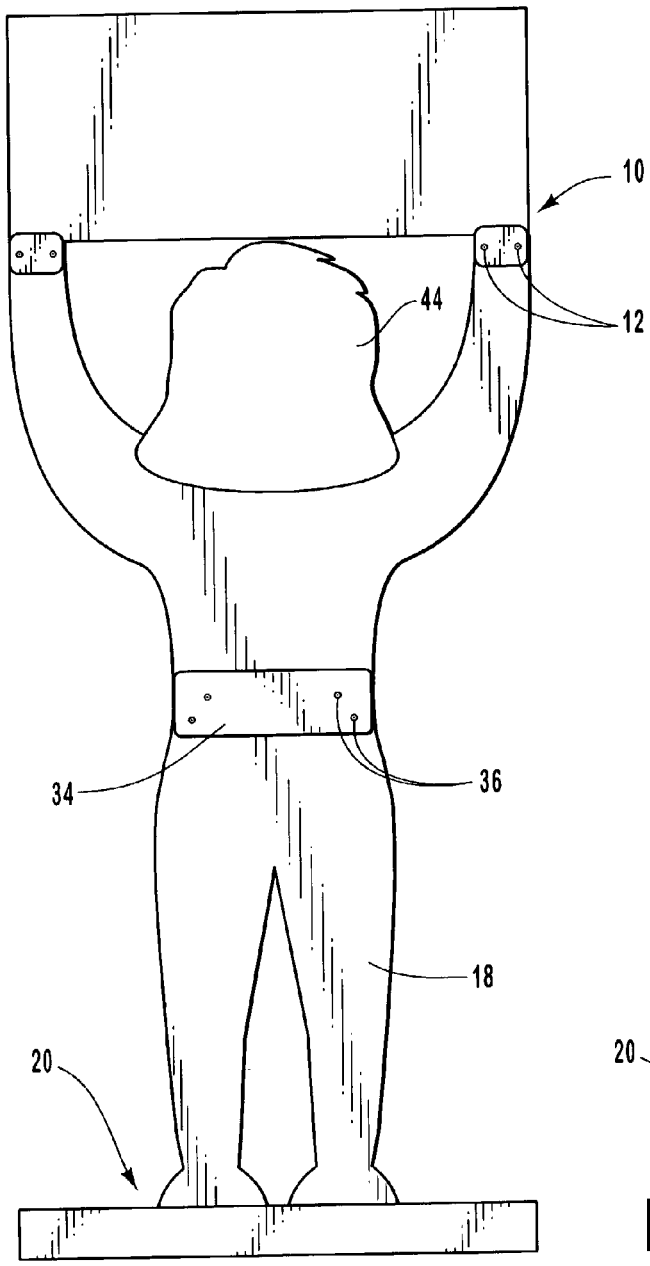
FIG. 6 is a back view of the embodiment shown in FIG. 1.
Figure 7:
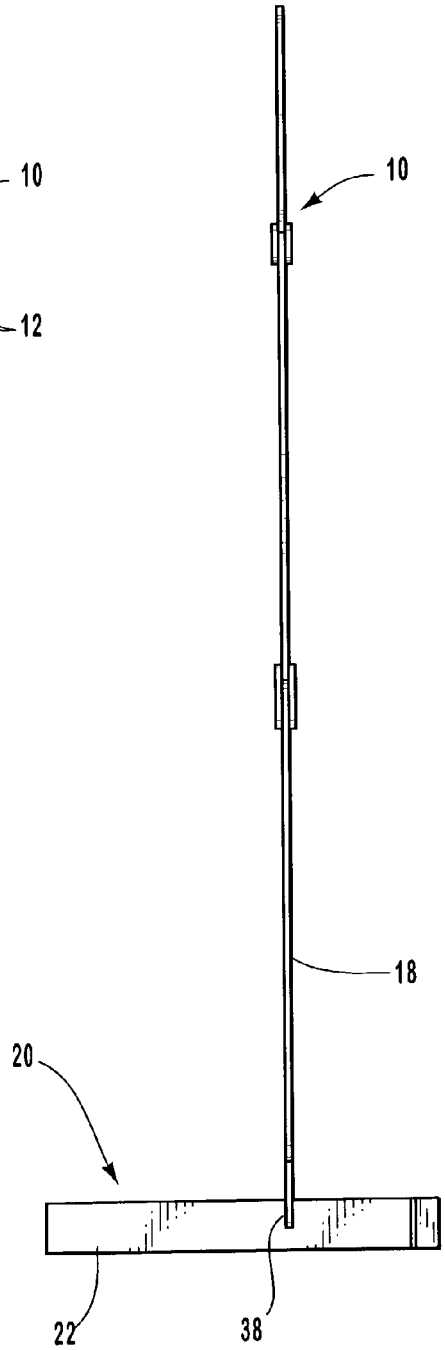
FIG. 7 is a right side view of the embodiment shown in FIG. 1.
Figure 8:
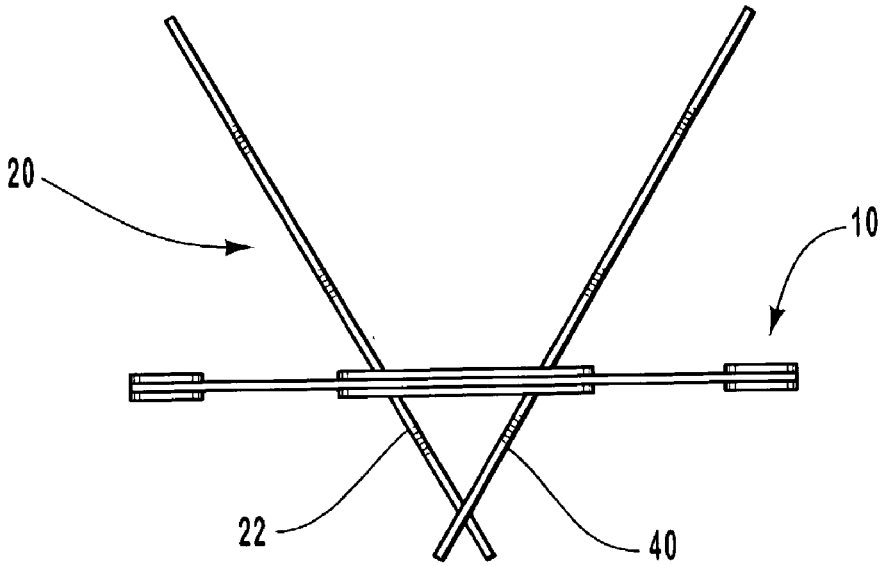
FIG. 8 is a top plan view of the embodiment shown in FIG. 1.
Figure 9:
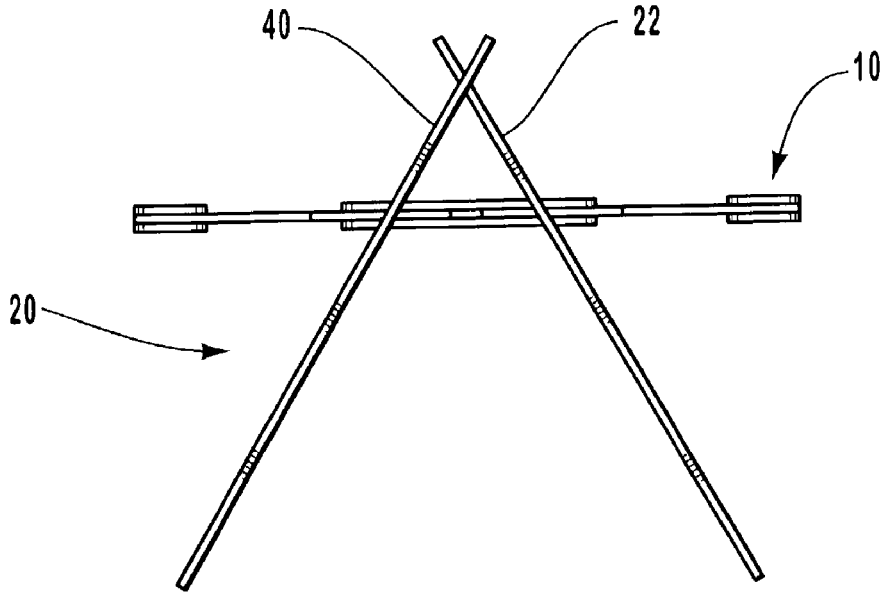
FIG. 9 is a bottom view of the embodiment shown in FIG. 1.

It will be observed that FIGS. 4 though 9 show various views of the embodiment of FIG. 1. FIG. 6 shows, in accordance with some embodiments of the present invention, some hair 44 placed at the backside of the planar FIG. 16.

Figure 10:
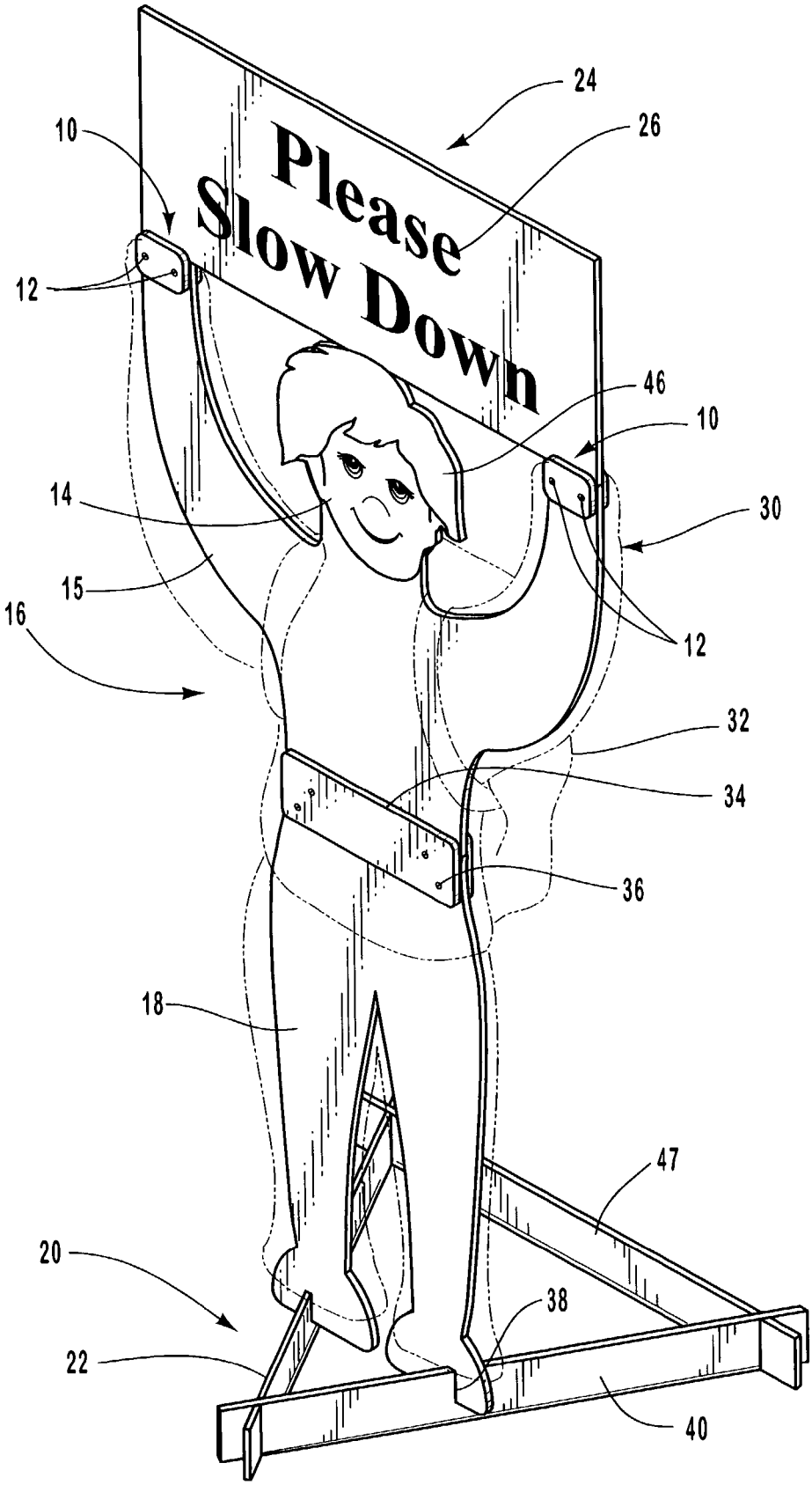
FIG. 10 is a perspective view of another embodiment of the present invention.

FIG. 10 shows one embodiment of the present invention wherein the planar FIG. 16 represents a child of the male gender. Hair 46 is here intended to represent a male hairdo. Additionally, FIG. 10 shows a base 20 that includes an optional additional back plank 47.

Figure 11:
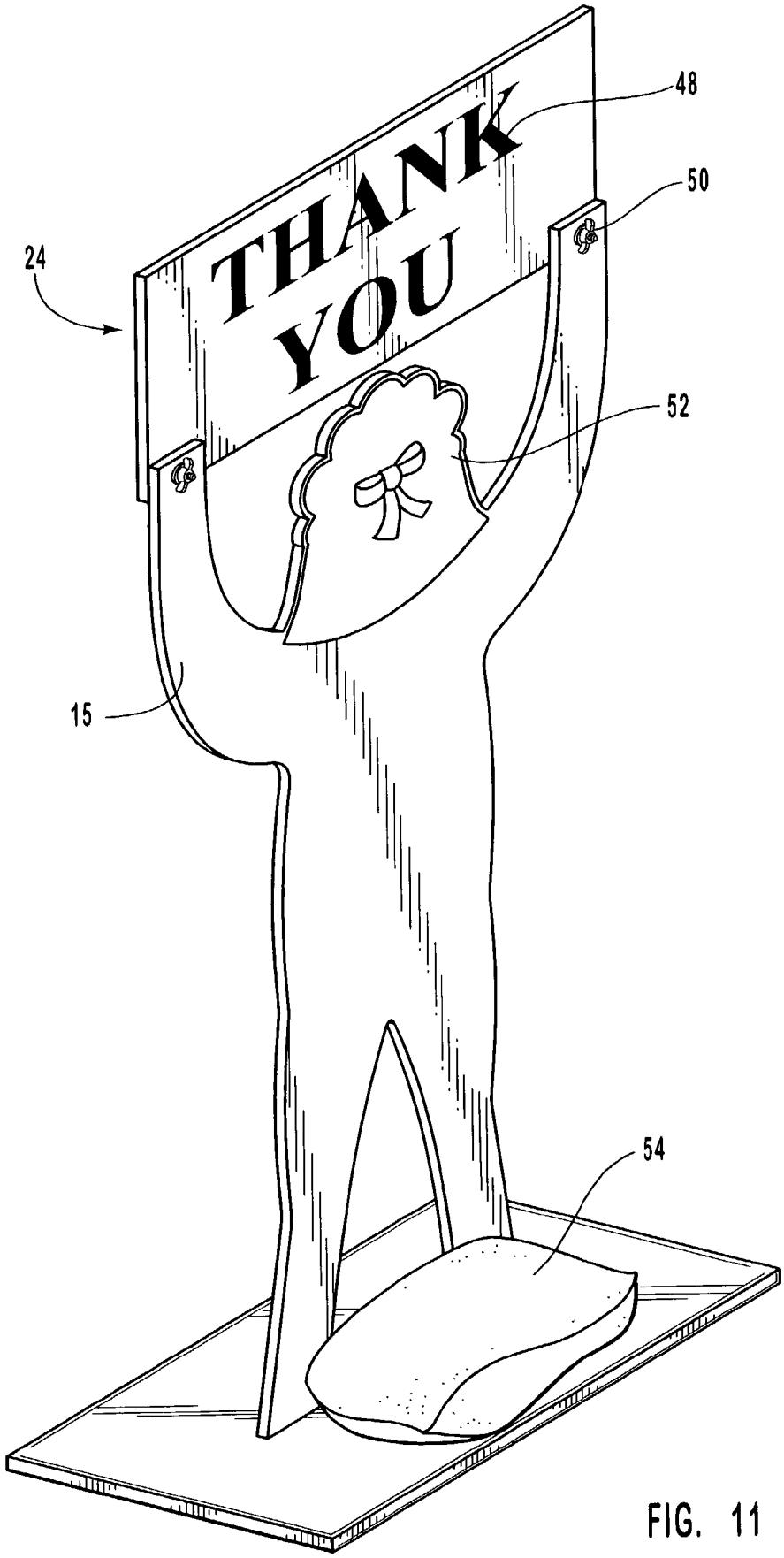
FIG. 11 is a perspective view of the backside of another embodiment of the present invention.

FIG. 11 shows various features that may be part of the present invention. For example, the design 48 can be located on the back of the sign 24. Also, in some embodiments, the arms 15 and the sign 24 may be connected by wing nuts 50. Furthermore, hair 52 may comprise decoration such as a bow, and a sandbag or other heavy weight 54 may be placed on the base 20 to provide additional stability to the planar FIG. 16.

Figure 12:
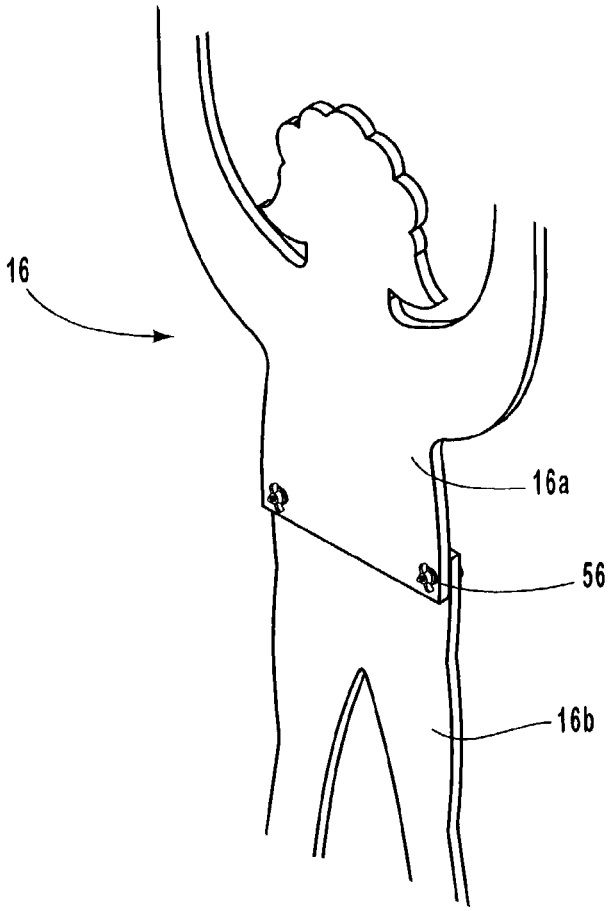
FIG. 12 shows, in accordance with one embodiment of the present invention, a planar figure divided into halves that are attached by a wing nut connection.

FIG. 12 shows an embodiment of the planar FIG. 16 wherein the top part 16*a* and the bottom part 16*b* are removably connected by wing nuts 56.

Figure 13:
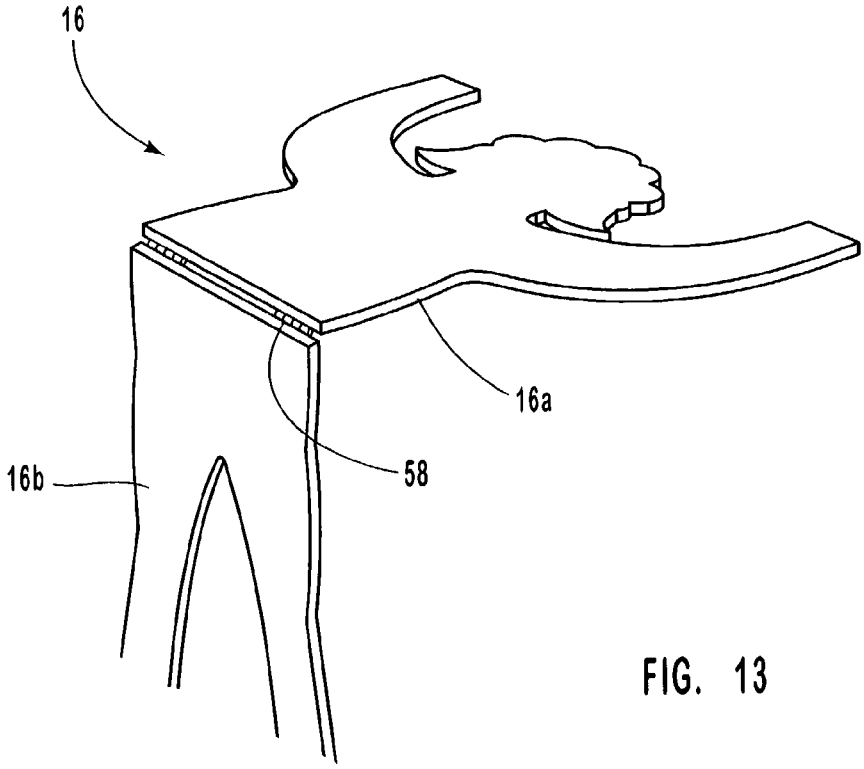
FIG. 13 shows, in accordance with one embodiment of the present invention, a planar figure divided into halves that are attached by a hinge connection.

FIG. 13 shows an embodiment of the planar FIG. 16 wherein the top part 16*a* and the bottom part 16*b* are connected by a hinge 58 that allows the planar FIG. 16 to be folded in two for easy transportation.

Figure 14:
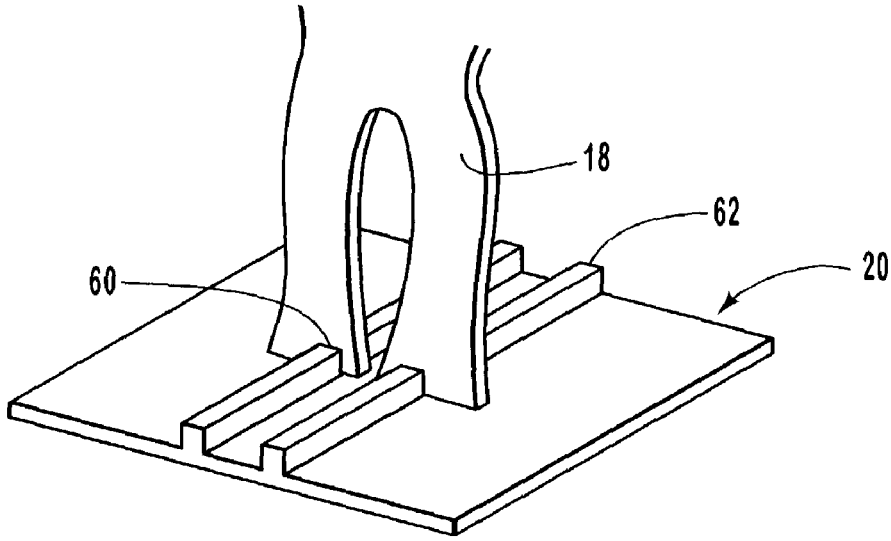
FIG. 14 shows one embodiment of the connection between the legs and the base of the planar figure.

FIG. 14 shows an embodiment wherein the base 20 is removably connected to the planar FIG. 16 via a notched lap joint. Here, legs 18 have notches 60 into which ridges 62 are inserted.

Figure 15:
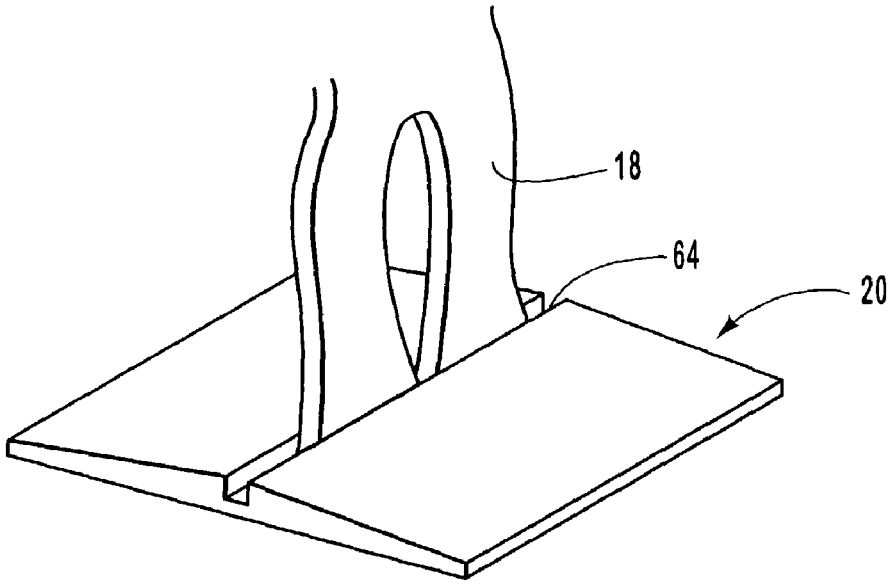
FIG. 15 shows another embodiment of the connection between the legs and the base of the planar figure.

FIG. 15 shows an embodiment wherein the base 20 is removably connected to the planar FIG. 16 via a notched channel. As is evident from the drawing, legs 18 are inserted into channel 64.

In FIG. 16, an example of yet another base 20 is shown. Here, base 20 is substantially planar, and the legs 18 are coupled to the base 20 by a simple connector 70. FIG. 16 also shows an example of an embodiment where the planar FIG. 16 and the sign 24 are integrally formed. Additionally, FIG. 16 shows an example of an interchangeable hairdo 66. In other words, as can be inferred from the drawing, hairdo 66 may be removed and replaced with another hairdo (not shown) to go with face 68.

Figure 17:
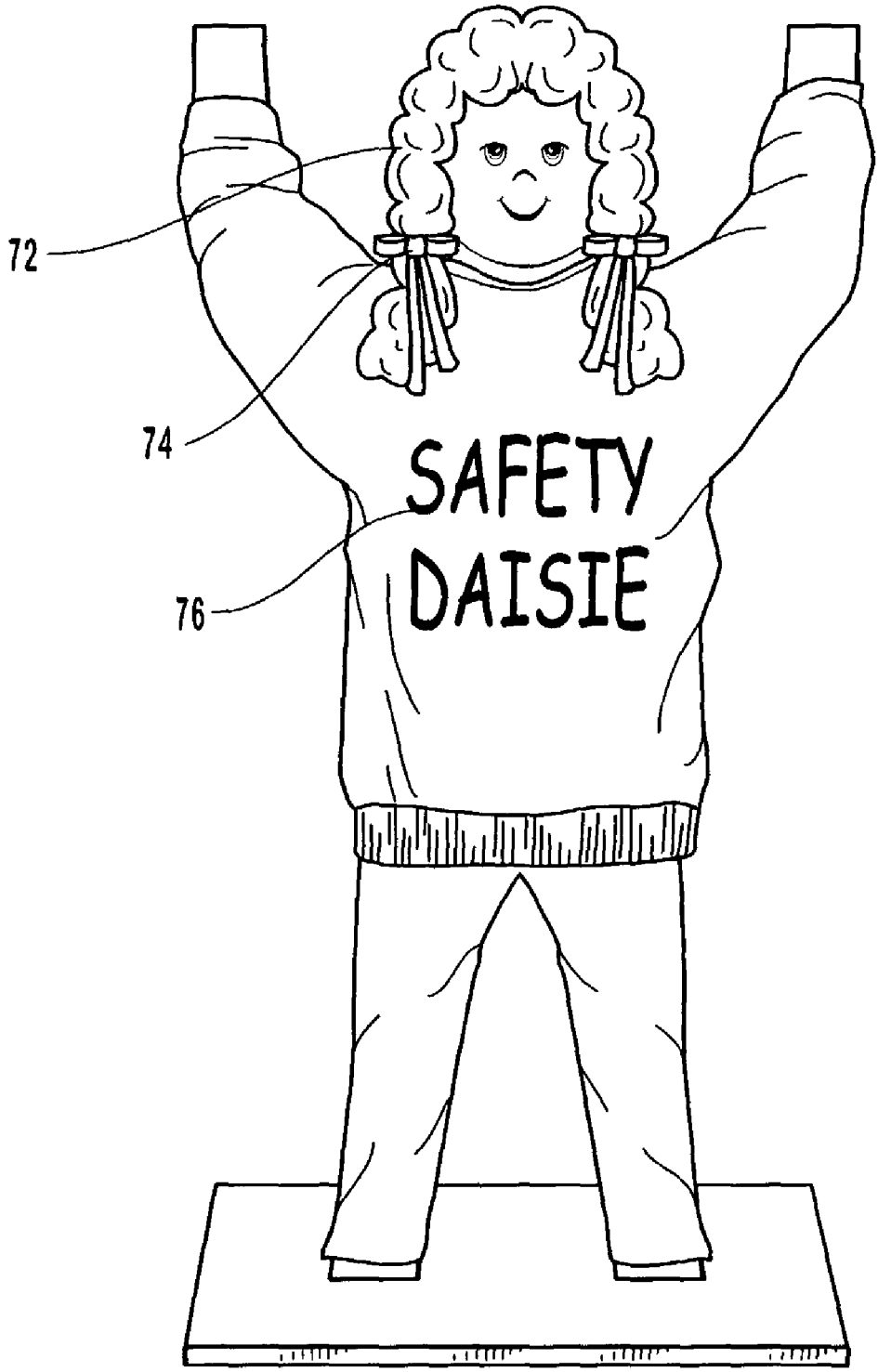
FIG. 17 is a front view of another embodiment of the present invention.

Finally, FIG. 17 shows one embodiment of the present invention that has hair 72 comprising a makeshift wig. Hair 72 also may have a ribbon 74 or other decor placed in it. As shown in FIG. 17, the clothes 30 may contain a design 76 on them; here, the design 76 represents a nickname for the planar FIG. 16. Additionally, the clothes 30 may be arranged so as to achieve a different look. For example, as shown here, sleeves or pant legs may be pushed up to achieve a more casual look.

Hence, it should be apparent from the above description that the present invention provides an eye-catching, easy-to-assemble, and inexpensive-to-manufacture road stand. When placed near a roadway (which can include any kind of road or path, including those in parking lots), this road stand can significantly increase the chances that passers-by will notice the sign accompanying the road stand. This attention-grabbing road stand thus can be extremely valuable when used to promote safety near vehicular traffic, pedestrian traffic, or other kinds of traffic, including those involving the use of bicycles and roller blades, and those involving school children. The present road stand can also prove valuable for advertising purposes such as, for example, advertising haircut services for children.

It is underscored that the present invention may be embodied in other specific forms without departing from its spirit or essential characteristics. The described embodiments herein should be deemed only as illustrative. Indeed, the appended claims indicate the scope of the invention; the description, being used for illustrative purposes, does not limit the scope of the invention. All variations that come within the meaning and range of equivalency of the claims are to be embraced within their scope.

What is claimed is:

1. A roadway stand apparatus comprising:

a substantially planar figure having front and back surfaces, wherein said planar figure resembles a child having a head, arms and legs;

a piece of clothing comprising cloth and covering at least a portion of said front and back surfaces;

a sign coupled to and supported by the arms of the child, wherein the sign is supported by the arms above the head, and wherein said sign is configured to attract the attention of people passing by said planar figure; and a base coupled to the legs of the child and configured to support said planar figure, wherein said base comprises a plurality of members, wherein a first member of said plurality of members comprises a first notch and a second notch, wherein a second member of said plurality of members is coupled to said first member at said first notch, wherein at least one of said legs is coupled to said first member at said second notch, and wherein said first and second members intersect in front of said planar figure.

2. The apparatus of claim 1, wherein said sign is removeably coupled to the arms of the child.

3. The apparatus of claim 1, wherein said sign is coupled to the arms of the child by wing nuts.

4. The apparatus of claim 1, wherein the planar figure comprises an upper body portion comprising the arms and a lower body portion comprising the legs, and wherein the upper body portion and the lower body portion are coupled by a hinge.

5. The apparatus of claim 1, wherein the planar figure comprises an upper body portion comprising the arms and a lower body portion comprising the legs, and wherein the upper body portion and the lower body portion are separate interchangeable pieces that are selectively coupled by a slip joints.

6. The apparatus of claim 1 wherein the planar figure comprises an upper body portion comprising the arms and a lower body portion comprising the legs, and wherein the upper body portion and the lower body portion are separate interchangeable pieces that are coupled by wing nuts.

7. The apparatus of claim 1, further comprising apparel for the child covering at least a portion of said front and back surfaces.

8. The apparatus of claim 7, wherein said apparel is painted onto said exterior surface of said planar figure.

9. The apparatus of claim 7, wherein said apparel comprises a sticker that is coupled to said exterior surface of said planar figure.

10. The apparatus of claim 7, wherein said apparel is a piece of clothing that comprises cloth and is configured to be worn by a child having a height similar to a height of said planar figure.

11. The apparatus of claim 1, wherein said base is transverse to said planar figure.

12. The apparatus of claim 11, wherein said first member is coupled transversely to said second member.

13. The apparatus of claim 1 wherein said base is coupled to said planar figure via a notched lap joint.

14. The apparatus of claim 1, wherein said base is coupled to the legs of said planar figure via a notched channel.

15. The apparatus of claim 1, wherein said planar figure further includes a sticker representing a face and an accompanying hairdo, said sticker being coupled to an exterior surface of said planar figure.

16. The apparatus of claim 1, wherein said planar figure further includes a sticker coupled to an exterior surface of said planar figure, said sticker representing a hairdo.

17. The apparatus of claim 1, wherein said arms are uplifted to support said sign above a portion of said planar figure that resembles the head of the child.

18. The apparatus of claim 1 wherein said sign is substantially planar.

19. The apparatus of claim 1, wherein said planar figure comprises plastic.

20. The apparatus of claim 1, wherein said planar figure comprises wood.

21. The apparatus of claim 1, wherein said planar figure comprises an aluminum-plastic composite material.

22. The apparatus of claim 1, wherein said sign comprises plastic.

23. The apparatus of claim 1, wherein said sign comprises wood.

24. The apparatus of claim 1, wherein said sign comprises metal.

25. An apparatus comprising:

a substantially planar figure having front and back surfaces, wherein said planar figure resembles a child having an upper body portion comprising a head and arms, and a lower body portion comprising legs, said upper body portion being coupled to said lower body portion;

a piece of clothing comprising cloth and covering at least a portion of said front and back surfaces;

a sign coupled to and supported by the arms of the child, wherein the sign is supported by the arms above the head, and wherein said sign is configured to attract the attention of people passing by said planar figure; and a base coupled to the legs of the child and configured to support said planar figure, wherein said base comprises a plurality of members, wherein a first member of said plurality of members comprises a first notch and a second notch, wherein a second member of said plurality of members is coupled to said first member at said first notch, wherein at least one of said legs is coupled to said first member at said second notch, and wherein said first and second members intersect in front of said planar figure.

26. The apparatus of claim 25, wherein said upper body portion and said lower body portion are selectively coupled by a slip joints.

27. The apparatus of claim 25, wherein the arms of the child and said sign are selectively coupled by a slip joints.

28. The apparatus of claim 25, wherein the arms of the child and said sign are coupled by wing nuts.

29. The apparatus of claim 25 wherein said upper body portion and said lower body portion are coupled by a hinge.

30. The apparatus of claim 25 wherein said sign extends integrally from said planar figure.

31. The apparatus of claim 25 wherein said clothing is painted onto said portion of at least one of (i) the upper body portion and (ii) the lower body portion.

32. The apparatus of claim 25 wherein said clothing comprises a sticker coupled to said portion of at least one of (i) the upper body portion and (ii) the lower body portion.

33. The apparatus of claim 25 wherein said clothing is three-dimensional.

34. The apparatus of claim 25 wherein said base is transverse to said planar figure.

35. The apparatus of claim 25, wherein said planar figure further comprises a face of the child.

36. The apparatus of claim 25, wherein said planar figure further comprises an interchangeable hairdo.

37. The apparatus of claim 25, wherein said arms are uplifted to support said sign above a portion of said planar figure that resembles the head of the child.

38. The apparatus of claim 25, wherein said planar figure comprises plastic.

39. The apparatus of claim 25, wherein said planar figure comprises wood.

40. The apparatus of claim 25, wherein said planar figure comprises an aluminum-plastic composite material.

41. The apparatus of claim 25, wherein said sign comprises plastic.

42. An apparatus comprising:

a substantially planar figure, having front and back surfaces, wherein said planar figure resembles a child, and wherein said planar figure includes an upper body portion comprising a head and arms, and a lower body portion comprising legs, said upper body portion selectively coupled to said lower body portion, and wherein said arms are uplifted;

a piece of clothing comprising cloth and covering at least a portion of said front and back surfaces;

a sign coupled to and supported by the arms of the child, wherein the sign is supported by the arms above the head, and wherein said sign is configured to attract the attention of people passing by said planar figure, said sign coupled to said arms by slip joints; and a base coupled to the legs of the child and configured to support said planar figure, wherein said base is transverse to said planar figure, wherein said base comprises a plurality of members, wherein a first member of said plurality of members comprises a first notch and a second notch, wherein a second member of said plurality of members is coupled to said first member at said first notch, wherein at least one of said legs is coupled to said first member at said second notch, and wherein said first and second members intersect in front of said planar figure.

43. The apparatus of claim 42, further comprising a design coupled to said planar figure, said design representing a child's face.

44. The apparatus of claim 43 wherein said design comprises a sticker.

45. The apparatus of claim 42 further comprising a design coupled to said planar figure, said design representing a hairdo.

46. The apparatus of claim 42, wherein said planar figure comprises plastic.

47. The apparatus of claim 42, wherein said planar figure comprises wood.

48. The apparatus of claim 42, wherein said planar figure comprises an aluminum-plastic composite material.

49. The apparatus of claim 42, wherein said sign comprises plastic.

50. A method for providing a sign-bearing road stand, the method comprising:

providing a substantially planar figure having front and back surfaces, wherein said planar figure resembles a child having a head, arms and legs;

covering at least a portion of said front and back surfaces with a piece of clothing that comprises cloth;

coupling a sign to the arms of the child;

supporting the sign by two of the arms above the head;

coupling the legs of the child to a base that is transverse to said planar figure, wherein said base comprises a plurality of members, wherein a first member of said plurality of members comprises a first notch and a second notch;

coupling a second member of said plurality of members to said first member at said first notch, wherein said first and second members intersect in front of said planar figure;

coupling one of said legs to said first member at said second notch; and using the sign to attract the attention of people passing by said planar figure.

51. The method of claim 50, wherein said coupling a sign comprises using a slip joint.

52. The method of claim 50, wherein said coupling a sign comprises using a wing nut.

53. The method of claim 50 further comprising placing a backpack on at least a portion of said planar figure.

54. The method of claim 50, further comprising placing a design of a face on said planar figure.

55. A method for providing a sign-bearing road stand, the method comprising:

providing a substantially planar figure having front and back surfaces, wherein said planar figure resembles a child having a head, legs and upright arms;

covering at least a portion of said front and back surfaces with a piece of clothing that comprises cloth;

removably coupling a sign to the arms of the child to position the sign above the head;

using the planar figure to support the sign;

supporting the sign by two of the arms above the head;

coupling the legs of the child to a base, wherein said base comprises a first member and a second member, said first member having a first notch and a second notch;

coupling said second member to said first member at said first notch, wherein said first and second members intersect in front of said planar figure;

coupling one of said legs to said first member at said second notch;

using the base to support the planar figure; and using the sign to attract the attention of people passing by said planar figure.

56. A method of claim 55, wherein the base is transverse to said planar figure.

57. A method of claim 55, further comprising coupling a backpack to said planar figure.

58. A method of claim 55, further comprising coupling children's apparel to said planar figure.

* * * * *